US008807293B2

(12) United States Patent
Lavoie

(10) Patent No.: US 8,807,293 B2
(45) Date of Patent: Aug. 19, 2014

(54) BRAKE SYSTEM FOR MANUAL HOISTING

(71) Applicant: Fabien Lavoie, Grand-Mère (CA)

(72) Inventor: Fabien Lavoie, Grand-Mère (CA)

( * ) Notice: Subject to any disclaimer, the term of this patent is extended or adjusted under 35 U.S.C. 154(b) by 118 days.

(21) Appl. No.: 13/654,956

(22) Filed: Oct. 18, 2012

(65) Prior Publication Data

US 2013/0092480 A1 Apr. 18, 2013

Related U.S. Application Data

(60) Provisional application No. 61/548,279, filed on Oct. 18, 2011.

(51) Int. Cl.
*B65H 59/16* (2006.01)

(52) U.S. Cl.
USPC ..... 188/65.1; 188/65.4

(58) Field of Classification Search
USPC ..... 188/65.1, 65.4, 65.5
See application file for complete search history.

(56) References Cited

U.S. PATENT DOCUMENTS

| | | | | | |
|---|---|---|---|---|---|
| 1,890,992 | A * | 12/1932 | Janssen | ..... | 188/65.1 |
| 4,576,248 | A * | 3/1986 | Marom | ..... | 182/5 |
| 5,156,240 | A * | 10/1992 | Ostrobrod | ..... | 188/65.1 |
| 5,280,879 | A | 1/1994 | Kreuter | | |
| 5,921,353 | A * | 7/1999 | Day | ..... | 188/65.4 |
| 6,234,454 | B1 * | 5/2001 | Vassioukevitch | ..... | 254/391 |
| 6,568,511 | B1 * | 5/2003 | Day | ..... | 188/65.4 |
| 7,341,404 | B2 | 3/2008 | Tjader | | |
| 7,661,655 | B2 | 2/2010 | Tjader | | |
| 2008/0149433 | A1 * | 6/2008 | Barzilai | ..... | 188/65.5 |

FOREIGN PATENT DOCUMENTS

| | | | | |
|---|---|---|---|---|
| GB | 265 357 | | 2/1927 | |
| GB | 340427 | A * | 1/1931 | ..... B66D 3/10 |
| GB | 381 396 | | 10/1932 | |

OTHER PUBLICATIONS

Powered Hoists, Chance, section 1150, Jul. 2010, Centralia, Missouri, United States http://www.hubbellpowersystems.com/catalogs/lineman.

* cited by examiner

*Primary Examiner* — Thomas Irvin
(74) *Attorney, Agent, or Firm* — Norton Rose Fulbright Canada LLP

(57) ABSTRACT

A brake system comprising a structural unit adapted to be connected to a structure and defining a channel for the axial movement of a hoisting rope therein. A brake unit has a brake pad and an arm secured to one another for concurrent movement and movably mounted to the structural unit by at least one joint. The arm is in operative contact with a user end of the hoisting rope to be displaced with the brake pad between a hoisting position by a tautening of the hoisting rope, in which hoisting position the brake pad is distanced from the hoisting rope in the structural unit to allow movement of the hoisting rope in both pulling and releasing directions of the axial movement, and a braking position by a release of tension in the hoisting rope, in which the brake pad is displaced into contact with the hoisting rope.

15 Claims, 7 Drawing Sheets

BRAKE SYSTEM FOR MANUAL HOISTING

CROSS-REFERENCE TO RELATED APPLICATION

The present application claims priority on U.S. patent application Ser. No. 61/548,279, filed on Oct. 18, 2012, incorporated herein by reference.

FIELD OF THE APPLICATION

The present application relates to hoisting systems by which users manually hoist loads by way of a cable, rope, etc, in addition to mechanical units such as sets of pulleys or devices such as capstans, and more particularly to a brake system for braking movement of the hoisting cable or rope.

BACKGROUND OF THE ART

It is commonly known to provide pulley arrangements and/or devices such as capstans to help users in manually hoisting heavy loads. The pulleys and devices such as the capstans reduce the load at the user end, whereby the user can manually hoist the load with the weight of the load being substantially reduced at the user end.

Brake systems or lock systems have been created in the event that the user wants to release the hoisting rope (or cable, etc) while the load is lifted in the air. The existing brake systems are applied when the tension in the hoisting rope is released, for instance by the user letting go of the hoisting rope.

In order to lower the load, such existing brake systems typically require additional manipulations by the user, for instance, by way of a secondary rope that must be manipulated by the user to release the brake while hoisting the load with the other hand. However, this type of system is accident-prone in that the user may perform inadequate maneuvers in emergency situations, and drop the load. Moreover, with such systems, the user must typically have one hand on the hoisting rope, and another on the secondary rope, and this is not ideal for releasing gradually the hoisting rope when lowering a load.

SUMMARY OF THE APPLICATION

It is therefore an aim of the present disclosure to provide a brake system for hoisting rope that addresses issues associated with the prior art.

Therefore, in accordance with the present application, there is provided a brake system for hoisting rope, comprising: a structural unit adapted to be connected to a structure and defining a channel for the axial movement of a hoisting rope therein; and a brake unit having a brake pad and an arm secured to one another for concurrent movement and movably mounted to the structural unit by at least one joint, the arm being in operative contact with a user end of the hoisting rope to be displaced with the brake pad between a hoisting position by a tautening of the hoisting rope, in which hoisting position the brake pad is distanced from the hoisting rope in the structural unit to allow movement of the hoisting rope in both pulling and releasing directions of the axial movement, and a braking position by a release of tension in the hoisting rope, in which the brake pad is displaced into contact with the hoisting rope by the arm reacting to the release in tension in the hoisting rope at the user end, whereby the hoisting rope is held captive between the brake pad and a surface of the channel in the braking position.

DESCRIPTION OF THE PREFERRED EMBODIMENTS

Figure 1:
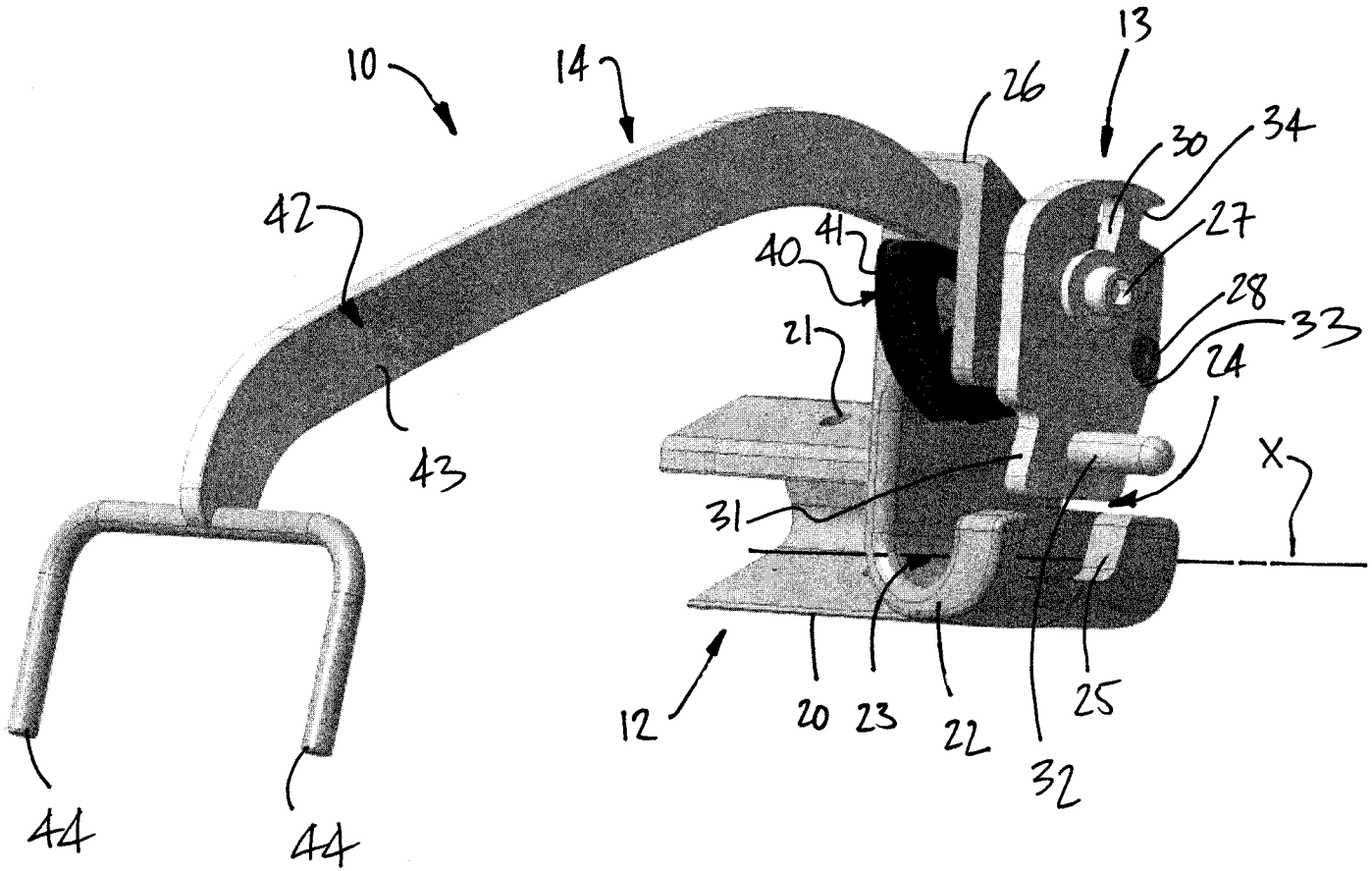
FIG. 1 is a perspective view of a brake system for hoisting rope in accordance with an embodiment of the present disclosure.
Figure 5:
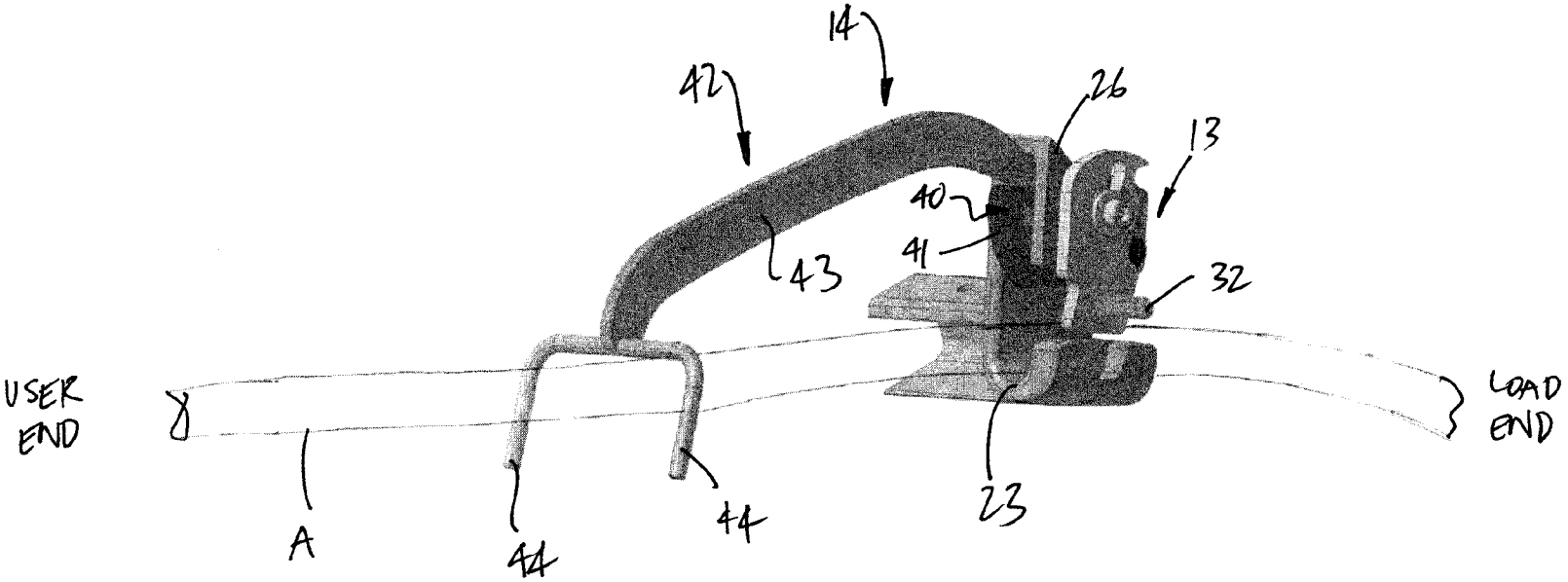
FIG. 5 is a perspective view of the brake system of FIG. 1 with a hoisting rope, with the brake unit in a hoisting position.
Figure 6:
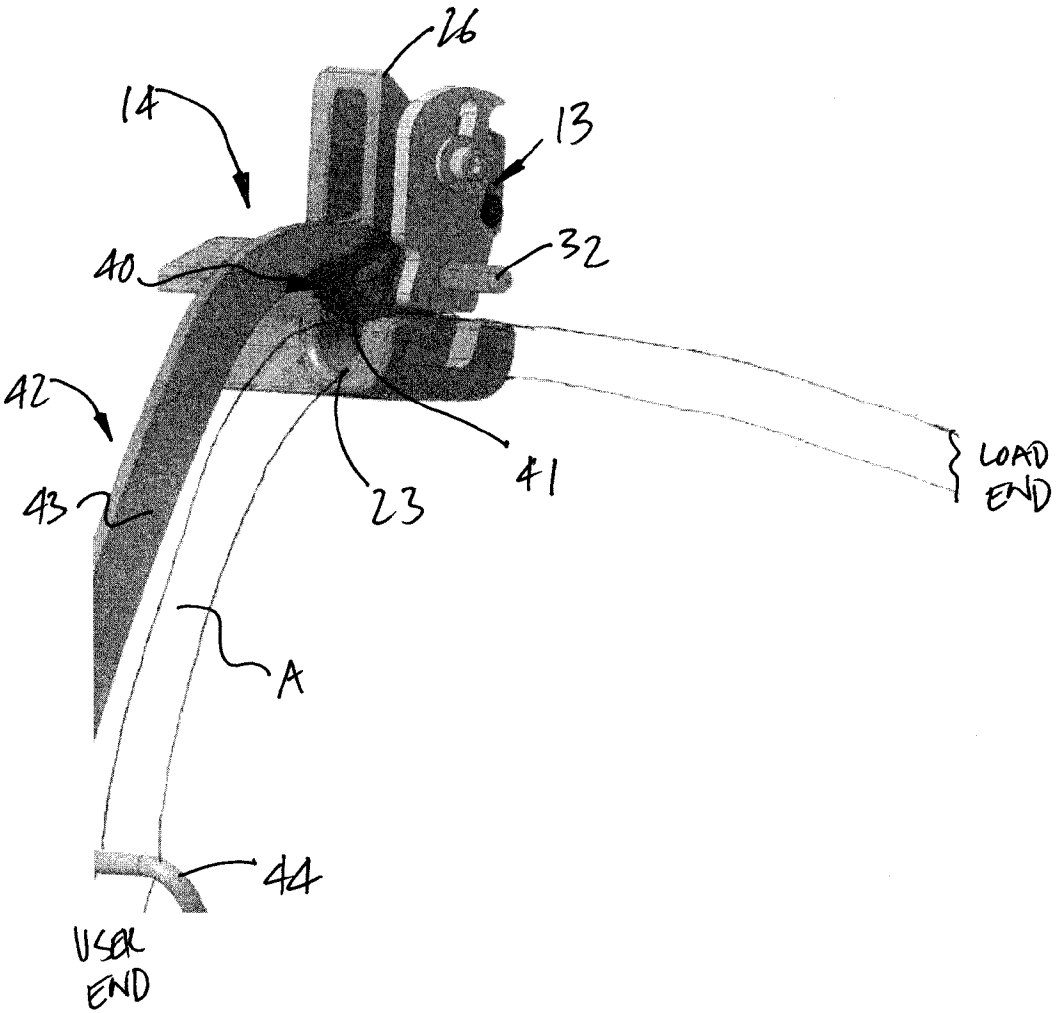
FIG. 6 is a perspective view of the brake system of FIG. 1 with a hoisting rope, with the brake unit in a braking position.

Referring to the drawings, and more particularly to FIG. 1, a brake system for a hoisting rope, cable, etc is generally illustrated at 10. For simplicity purposes, reference is made to hoisting rope, although the brake system may be used with any appropriate hoisting means, such as cable, chain, cord, etc. The use of hoisting rope is intended to cover all possible hoisting means of such type. In FIGS. 5 and 6, the brake system 10 is illustrated in an operative arrangement with a hoisting rope A.

As shown in FIG. 1, the brake system 10 has a structural unit 12, a gate unit 13 and a brake unit 14.

The structural unit 12 is the part of the brake system 10 that is anchored to a structure and that supports the movable components of the brake system 10, namely the gate unit 13 and the brake unit 14. The structural unit 12 is also the interface of the brake system 10 with the hoisting rope A (FIGS. 5 and 6), and hence supports a part of a load during braking.

The gate unit 13 may be provided in the brake system 10. The gate unit 13 is devised to hold captive the hoisting rope A within the structural unit 12.

The brake unit 14 brakes the movement of the hoisting rope A along its longitudinal axis when sliding or translating along the structural unit 12. The brake unit 14 is displaceable as a function of movements performed by a user person hoisting a load, by pulling or releasing the hoisting rope A, as described in further detail hereinafter.

Still referring to FIG. 1, the structural unit 12 has a connector portion 20 by which it is anchored to a structure. The structure may be any of a vehicle, a post, a frame, parts of a building, or any other appropriate stable structure capable of supporting the brake system 10, considering that loads of a hoisting maneuver will be sustained at least partially by the brake system 10. In FIG. 1, the connector portion 20 is illustrated as being a C-channel with bores 21. However, any other type of structural configuration is considered for the connector portion 20, as long as it can sustain the loads to which the brake system 10 will be subjected.

The structural unit 12 further features a rope interface 22 integral with the connector portion 20 in FIG. 1. The rope interface 22 defines a channel 23 in which the hoisting rope A will slide along its longitudinal axis, and thus approximately along axis X. Therefore, the rope interface 22 typically has an arcuate section to allow this translational movement of the hoisting rope A relative to the channel 23. The rope interface 22 has a J shape, thereby defining a clearance 24. The clearance 24 is sized so as to allow the hoisting rope A to be laterally inserted into the channel 23 of the rope interface 22. In an alternative embodiment, the rope interface 22 may be closed off with the hoisting rope A being inserted by a free end into the channel 23. It may be desired to close off the clearance 24, whereby an aperture 25 is defined in the rope interface 22 to receive a part of the gate unit 13, as will be described hereinafter.

A brake support 26 is positioned atop the rope interface 22 and is integral therewith. The brake support 26 is shaped as a housing to accommodate a portion of the brake unit 14 and allow a pivoting movement thereof relative to the structural unit 12. Moreover, pivot 27 and stop 28 are positioned on a lateral wall of the brake support 26. The pivot 27 and the stop 28 are used to interface the gate unit 13 to the structural unit 12. The gate unit 13 has a slot 30 defined in its body, with the slot 30 having an obround shape or other appropriate elongated shape. Therefore, the body of the gate unit 13 is operatively connected to the structural unit 12 by the pivot 27 threaded through the slot 30. An appropriate enlarged head and, possibly, washer are provided at the free end of the pivot 27 to hold the gate unit 13 captive thereon. Accordingly, the gate unit 13 may pivot and translate relative to the structural unit 12 by way of the interaction between the pivot 27 and the slot 30. Hence, the joint formed by the pivot 27 and the slot 30 is a two degree of freedom (DOF) joint, although a single DOF joint could be used provided sufficient space is provided between the gate unit 30 and the boundaries of the clearance 24 to allow the lateral access of the hoisting rope A in the channel 23.

Figure 4:
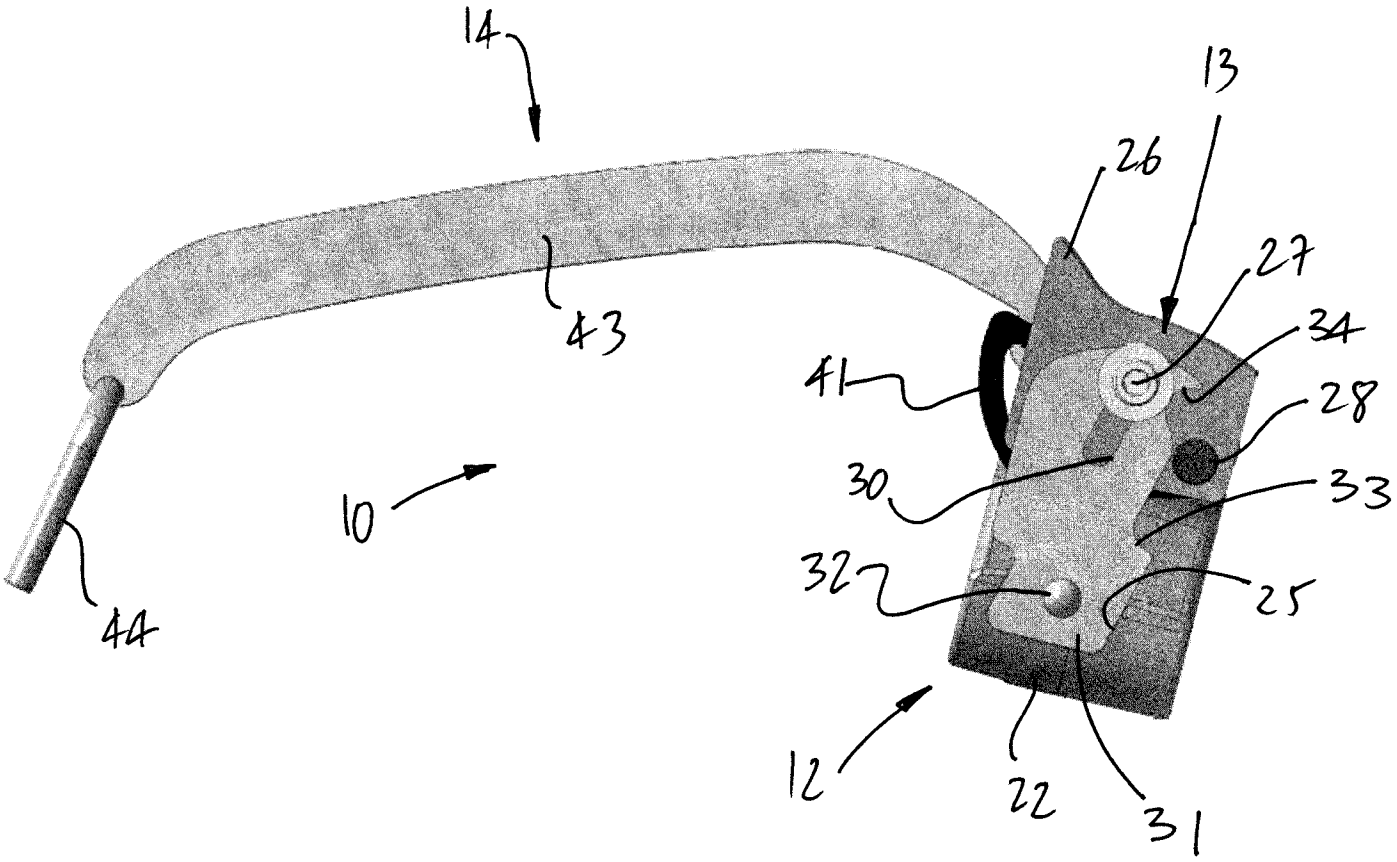
FIG. 4 is an elevational view of the brake unit of FIG. 1, with the gate unit in a closed position.

The gate unit 13 further comprises a tongue 31. The tongue 31 is sized so as to be accommodated in the aperture 25, as shown in FIG. 4. This complementary engagement, along with the weight of the gate unit 13, will generally ensure that the gate unit 13 remains in the closed position of FIG. 4 during the use of the brake system 10 for hoisting a load, thereby keeping the hoisting rope A captive therein. A handle 32 projects laterally from the gate unit 13. The handle 32 is used manually by a user of the brake system 10 to open or close the gate. Abutment 33 and depression 34 are also defined in the body of the gate unit 13 to control and limit its movement relative to the structural unit 12.

Figure 2:
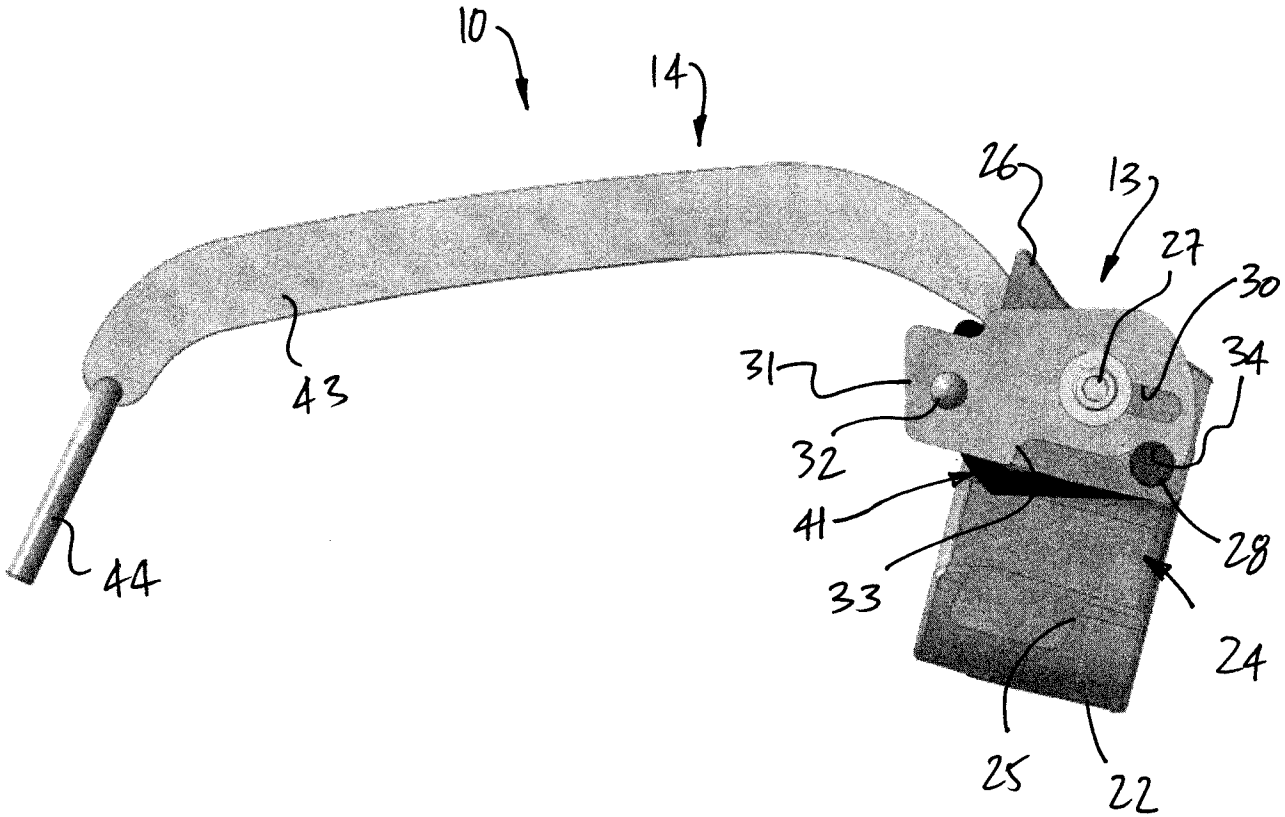
FIG. 2 is a side elevation view of the brake system of FIG. 1, with a gate unit being opened.
Figure 3:
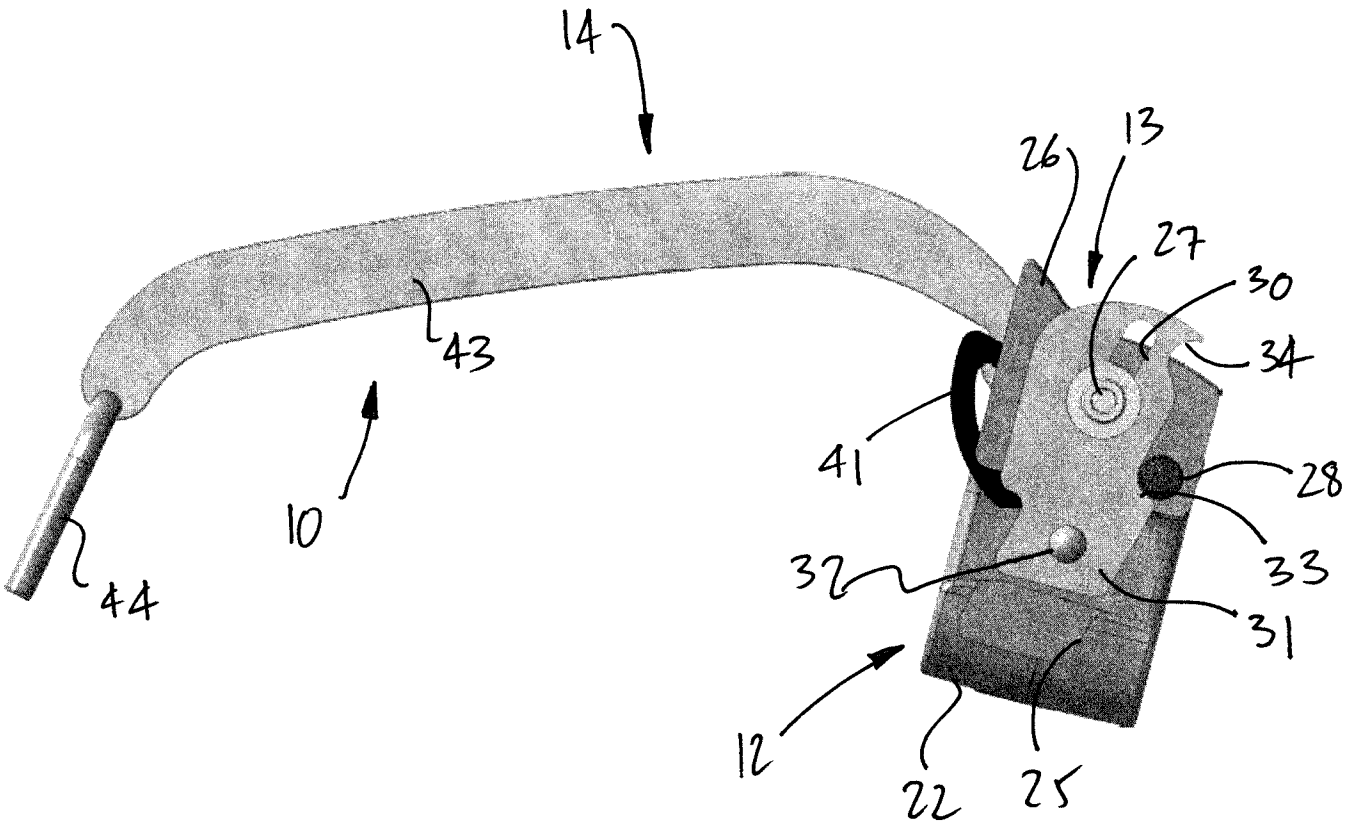
FIG. 3 is an elevational view of the brake unit of FIG. 1, with the gate unit in the process of being closed.

Referring sequentially to FIGS. 2, 3 and 4, the movement of the gate unit 13 relative to the structural unit 12 is described. In FIG. 2, the gate unit 13 is in an opened position relative to the structural unit 12. Therefore, the clearance 24 is opened, whereby hoisting rope A may be fitted into the rope interface 22. In the opened position of FIG. 2, the stop 28 is received in the depression 34 of the gate unit 13. Alternatively, a free end of the rope A may be threaded through the rope interface 22 in an embodiment of the brake system 22 without a lateral entry, such as the clearance 24, for the rope A.

In FIG. 3, the gate unit 13 is in the process of being displaced to its closed position. The body of the gate unit 13 has, therefore, pivoted relative to pivot 27, and the stop 28 abuts the abutment 33, resulting in the tongue 31 being in register with the aperture 25. It is also observed that the collaboration between the stop 28 and an edge of the body of the gate unit 13 will limit the gate unit 13 to translating downwardly or pivoting back to the opened position of FIG. 2.

In FIG. 4, the tongue 31 is accommodated in the aperture 25, in the closed position of the gate unit 13 relative to the structural unit 12. It is when the gate unit 13 is in the closed position of FIG. 4 that the hoisting rope A may be used to hoist a load, as the hoisting rope A is laterally captive in the structural unit 12.

It is pointed out that the gate unit 13 will tend to stay in the closed position of FIG. 4 by the effect of gravity (and/or spring). Therefore, according to an embodiment, the gate unit 13 must be handled to reach and stay in the opened position, otherwise the gate unit 13 will bias back to the closed position of FIG. 4 by the effect of gravity.

Referring now concurrently to FIGS. 1, 5 and 6, the brake unit 14 is described. The brake unit 14 has a brake pad 40. The brake pad 40 is shown as being a cam having a semicircular component with a braking surface 41 on a radial surface thereof. Other shapes and configurations are also possible for the brake pad 40. The radial surface is typically arcuate in section in view of an operative engagement of the braking surface 41 with the hoisting rope A. Moreover, the braking surface 41 may have friction means, such as teeth, a rugged surface treatment, etc. The brake unit 14 further comprises a release arm 42. The release arm 42 is integral with the brake pad 40, and moves relative to the brake support 26 of the structural unit 12, for instance in rotation and/or in translation by an appropriate joint(s). In an embodiment, the brake pad 40 and the arm 42 are monolithic. In the illustrated embodiment, the brake pad 40 is the cam that has the pivot axis located such that the cam 40 is eccentrically positioned relative to the rotational axis of the arm 42. Still in the illustrated embodiment, the center of the cam 40 is offset relative to the pivot axis of the release arm 42. Therefore, as shown in the combination of FIGS. 5 and 6, a movement (i.e., pivoting) of the brake unit 14 will cause the cam 40 to be lowered onto the hoisting rope A, at which point the braking surface 41 will come into contact with the hoisting rope A.

The release arm 42 has an elongated portion 43, with two prongs 44 at a free end of the elongated portion 43, in an inverted U-shape. Other configurations are possible as alternatives to the fork shape of the release arm 42, such as a closed loop instead of the prongs, or a simple transverse abutment, but the two-prong configuration illustrated in FIGS. 1, 5 and 6 is well suited for keeping the hoisting rope A captive between the prongs when a load is being hoisted, and to disengage the rope A from the release arm 42 when the rope A is not being handled. The brake unit 14 biases downwardly by the effect of gravity and, therefore, abuts the hoisting rope A when the latter is taut, as seen in FIGS. 5 and 6.

Figure 7:
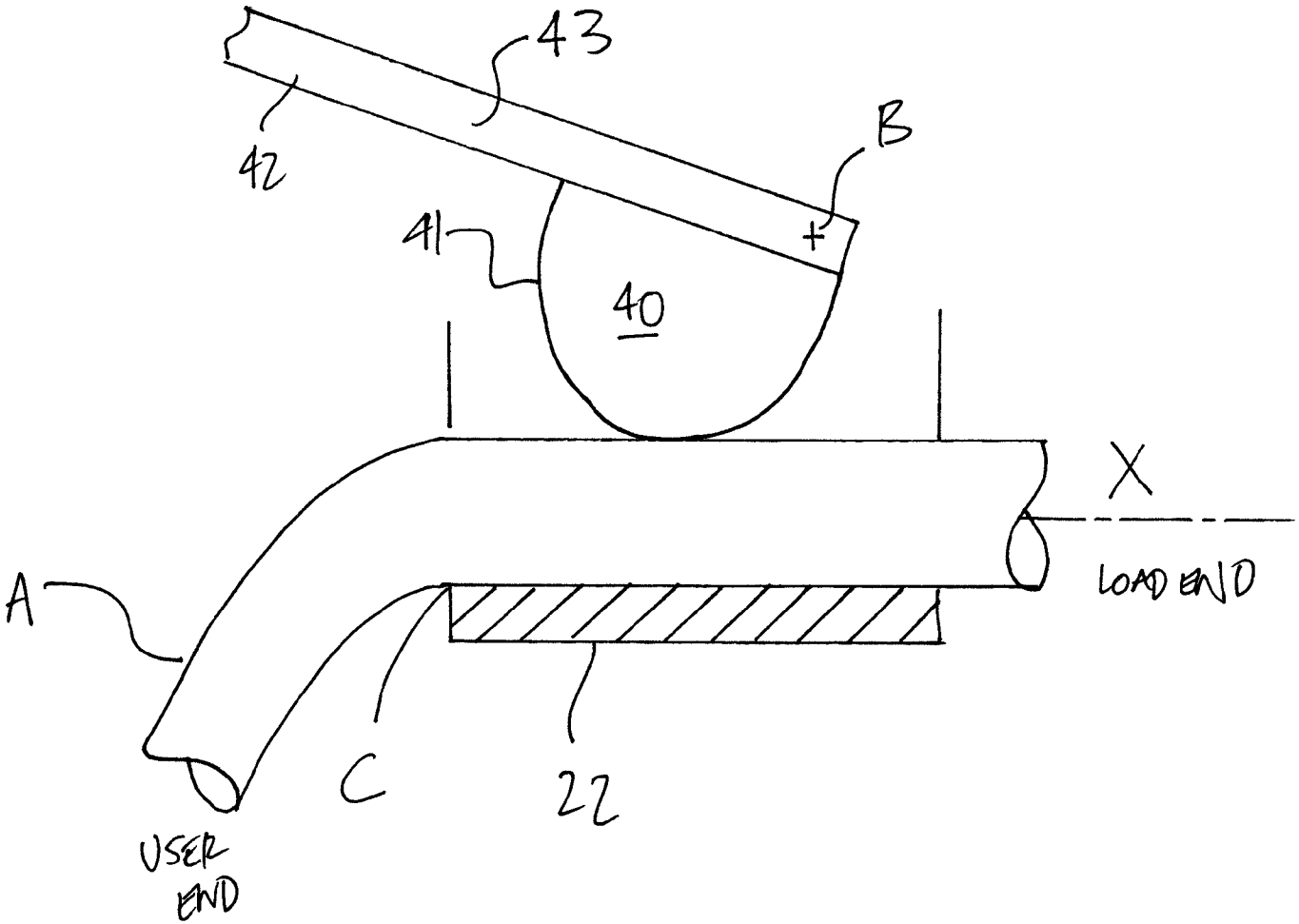
FIG. 7 is a schematic view illustrating an interaction between a cam of the brake system and the hoisting rope.

Referring to FIG. 7, it is observed that the pivot axis B of the release arm 42 is horizontally offset from an edge C of the rope interface 22 (i.e., not aligned on a horizontal axis). The hoisting rope A generally pivots about the edge C when a tension in the rope A is varied. This offset, combined to the eccentric position of the cam 40 relative to the pivot axis B (in the embodiment with the cam 40), causes a clearance between the braking surface 41 and the rope A even when the rope A is not fully taut.

Now that the various components of the brake system 10 have been described, a method of using the brake system 10 for hoisting loads is described. Referring to FIGS. 5 and 6, there is illustrated the end of the hoisting rope A being manually handled (user end), and the other end of the hoisting rope A being connected to the load (load end). The end of the hoisting rope A being connected to the load typically goes through various mechanical devices to help the user in hoisting a load. For instance, the brake system 10 is well suited to be used with a capstan. Alternatively, the hosting rope A passes through a set of pulleys that will lessen the weight of the load as felt on the user end of the hoisting rope A.

With the hoisting rope A being within the channel 23, the hoisting rope A passes through the prongs 44 of the brake unit 14. In FIG. 5, the brake system 10 is in a hoisting position in that the hoisting rope A is relatively taut straight as the user is hoisting a load by a pulling or retaining action on the free end of the rope A. Therefore, the hoisting rope A is generally horizontal, whereby the brake unit 14 is raised to the hoisting position, resulting in the cam 40 not engaging contact with the hoisting rope A. This allows the sliding or translational movement of the hoisting rope A in the channel 23 without any braking impact from the brake system 10. Moreover, the hoisting rope A does not rub against the cam 40 when the brake system 10 is in the hoisting position, by the space between the braking surface 41 and the channel 2 being sufficiently large (greater than a dimension of the rope A), to prevent any rub, although rub could also be accepted. Accordingly, the surface of the hoisting rope A will not be grated by the braking surface 41, avoiding premature wear of the hoisting rope A.

In FIG. 6, the brake unit 14 is shown in the braking position. In this position, the user has released the hoisting rope A, whereby the hoisting rope A is relatively loose on the user end. Therefore, by the effect of gravity, the release arm 42 of the brake unit 14 will pivot downwardly, resulting in the cam 40 coming into contact with the hoisting rope A. The friction between the braking surface 41 of the cam 40 and the hoisting rope A is sufficient so as to block movement of the rope A at the brake system 10, and thus support the load.

If the user decides to pull the hoisting rope A once more, the brake unit 14 will simply pivot to the hoisting position of FIG. 5 by the hoisting rope A reaching the tautened state, thereby releasing the brake system 10 and allowing movement of the hoisting rope A. The clearance between the braking surface 41 and the hoisting rope A may be large enough that the brake system 10 remains in the hoisting position of FIG. 5, despite the hoisting rope A being semi-taut (not fully taut as in FIG. 5, not loose as in FIG. 6). This feature is quite practical as a variation of tension in the hoisting rope A will impact the speed at which the load is lowered.

It is therefore observed that the brake system 10 does not require any other manipulation in lowering a load other than the releasing action of the user on the hoisting rope A. The brake system 10 therefore adapts to the logic of movements of the hoisting rope A, thereby simplifying the manipulations required to brake movement of the hoisting rope A relative to the load. Moreover, if the hoisting rope A is released at the user end by inadvertence, the brake system 10 will naturally be released as soon as the hoisting rope A loses its tension on the user end.

It is pointed out that the gate unit 13 is shown as being away from the closed position in FIGS. 5 and 6, for instance as being manipulated by a user keeping the gate unit 13. However, for safety purposes, the gate unit 13 should be closed when a load is hoisted via the brake system 10.

The invention claimed is:

1. A brake system for hoisting rope, comprising:

a structural unit adapted to be connected to a structure and defining a channel for the axial movement of a hoisting rope therein; and a brake unit having a brake pad and an arm secured to one another for concurrent movement and movably mounted to the structural unit by at least one joint, the arm being in operative contact with a user end of the hoisting rope to be displaced with the brake pad between a hoisting position by a tautening of the hoisting rope, in which hoisting position the brake pad is distanced from the hoisting rope in the structural unit to allow movement of the hoisting rope in both pulling and releasing directions of the axial movement, and a braking position by a release of tension in the hoisting rope, in which the brake pad is displaced into contact with the hoisting rope by the arm reacting to the release in tension in the hoisting rope at the user end, whereby the hoisting rope is held captive between the brake pad and a surface of the channel in the braking position.

2. The brake system according to claim 1, wherein the arm is pivotally mounted to the structural unit by the at least one joint, and the brake pad is a cam displaced into contact with the hoisting rope.

3. The brake system according to claim 2, wherein the cam has a semi-circular shape with a center offset from an axis of the joint, such that the cam is eccentrically displaced into contact with the hoisting rope in the braking position.

4. The brake system according to claim 2, wherein an edge of the channel on a user end side of the brake system is horizontally offset from the axis of rotation of the joint.

5. The brake system according to claim 1, wherein a contact surface of the brake pad defines a channel of arcuate section.

6. The brake system according to claim 5, wherein the contact surface has teeth.

7. The brake system according to claim 1, wherein the arm has an inverted U-shape member at its free end for receiving the hoisting rope therein at least in the hoisting position.

8. The brake system according to claim 1, wherein the structural unit defines a clearance for lateral access of the hoisting rope into the channel.

9. The brake system according to claim 8, further comprising a gate unit operatively connected to the structural unit by a joint to block and allow access to the channel via the clearance.

10. The brake system according to claim 9, wherein the joint between the gate unit and the structural unit is a two degree-of-freedom joint allowing translation and rotation of the gate unit relative to the structural unit.

11. The brake system according to claim 10, wherein the gate unit has a tongue received in an aperture of the structural unit.

12. The brake system according to claim 9, wherein the gate unit is biased to a position in which the gate unit blocks the lateral access to the channel.

13. The brake system according to claim 1, wherein the structural unit comprises a J-shaped body with the channel being in a bottom of the J-shaped body.

14. The brake system according to claim 13, further comprising a housing at an upper end of the J-shaped body to receive the at least one joint.

15. The brake system according to claim 1, further comprising a capstan between the structural unit and a load end of the hoisting cable.

* * * * *